US006709288B1

(12) United States Patent
Hung et al.

(10) Patent No.: US 6,709,288 B1
(45) Date of Patent: Mar. 23, 2004

(54) ELECTRICAL CONNECTOR WITH POSITIONING MEMBERS

(75) Inventors: Ming-Yu Hung, Tu-chen (TW); Tsung-Po Lin, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/404,503

(22) Filed: Mar. 31, 2003

(30) Foreign Application Priority Data

Nov. 15, 2002 (TW) ..... 91218333 U

(51) Int. Cl.[7] ..... H01R 13/66
(52) U.S. Cl. ..... 439/570; 439/562; 439/571
(58) Field of Search ..... 439/570, 571, 439/569, 563, 83, 562, 566

(56) References Cited

U.S. PATENT DOCUMENTS 5,704,807 A 1/1998 Sherman et al.
5,961,347 A * 10/1999 Hsu ..... 439/570
6,012,949 A * 1/2000 Lok ..... 439/570
6,024,602 A * 2/2000 Mchugh et al. ..... 439/567
6,083,045 A 7/2000 Chiu
6,086,418 A * 7/2000 Chang ..... 439/573
6,089,882 A * 7/2000 Costello ..... 439/95
6,152,766 A * 11/2000 Wu et al. ..... 439/570
6,227,907 B1 * 5/2001 Wu et al. ..... 439/570
6,319,017 B1 * 11/2001 Kuo ..... 439/64

* cited by examiner

*Primary Examiner*—Gary Paumen
*Assistant Examiner*—Briggitte R. Hammond
(74) *Attorney, Agent, or Firm*—Wei Te Chung

(57) ABSTRACT

An electrical connector (1) includes an insulative housing (2), a plurality of contacts (3) received in the housing, and two positioning members (4) mounted on opposite sides of the housing. The housing defines two recesses (28) in respective opposite side portions of a bottom (27) thereof, and two symmetric grooves (24) in opposite sides of a rear surface (25) thereof. Each groove has an L-shaped profile, and defines a slot (26) in an adjacent sidewall of the housing. Each positioning member includes an engaging portion (41) having an L-shaped profile engaging in a corresponding groove of the housing, a medial portion (42) extending from the engaging portion and abutting a corresponding sidewall of the housing, and a solder portion (43) extending perpendicularly from the medial portion into a corresponding recess of the housing. The solder portion is adapted for mounting on a corresponding surface of a PCB by welding.

4 Claims, 2 Drawing Sheets

ELECTRICAL CONNECTOR WITH POSITIONING MEMBERS

BACKGROUND OF THE INVENTION

1. Field of the Invention

The present invention relates to an electrical connector, and particularly to an electrical connector having at least one positioning member for assisting in mounting the connector on a circuit substrate such as a printed circuit board (PCB).

2. Description of the Prior Art

A typical piece of electronic equipment commonly uses a variety of electrical connectors for accomplishing electrical connections between inner components of the electronic equipment or between systems, for signal transmission and power transfer. Commonly, there are several electrical connectors to be mounted on a same printed circuit board (PCB) for electrically connecting with each other. Methods of mounting the connectors on the PCB usually involve Through Hole Technology (THT) or Surface Mount Technology (SMT).

Regardless of the method used, solder ends of the connector are connected with the PCB by welding. The miniaturization of connectors has continued to advance, and a density of contacts of a modem connector is commonly very high. This requires that a housing of the connector be secured to the PCB, to provide strain relief for the multiple soldered ends of the contact connections. Further, positioning members mounted on opposite sides of the housing of the connector are soldered to the PCB to enhance the connecting strength between the housing and the PCB.

A conventional positioning member is disclosed in U.S. Pat. No. 5,704,807. The positioning member comprises an engaging portion, and a solder portion bending perpendicularly from the engaging portion. The engaging portion defines an opening. In assembly, the engaging portion is mounted in a channel of a flange formed on one side of the housing, and a retention tab formed in the channel is plugged into the opening. The solder portion extends outwardly from the housing for being mounted on a PCB by welding. As a result, valuable space on the PCB for accommodating items such as circuit lines is reduced. In addition, the configuration of the side of the housing for mounting the positioning member thereon is complex. This increases the difficulty of mounting the positioning member on the housing, and the difficulty of manufacturing the housing.

Another conventional positioning member is disclosed in U.S. Pat. No. 6,083,045. Each of two positioning members comprises a solder portion received within a bottom of a housing. Thus, the solder portion does not take up valuable space on the PCB for accommodating items such as circuit lines. The positioning member is S-shaped, and is stamped and formed from a metal sheet. This makes manufacturing of the positioning member more difficult. In addition, the housing must be formed with a configuration for receiving the positioning members therein. This makes manufacturing of the housing more difficult.

In view of the above, a new electrical connector with positioning members that overcome the above-mentioned disadvantages is desired.

SUMMARY OF THE INVENTION

Accordingly, an object of the present invention is to provide an electrical connector having positioning members for assisting in firmly mounting the connector on a circuit substrate such as a printed circuit board (PCB), wherein the positioning members facilitate accommodating of other electronic equipment and/or circuit lines on the PCB.

Another object of the present invention is to provide an electrical connector comprising a housing and positioning members mounted on the housing, wherein configurations of the positioning members and corresponding configurations of the housing are simple.

To achieve the above-mentioned objects, an electrical connector in accordance with a preferred embodiment of the present invention comprises an insulative housing, a plurality of contacts received in the housing, and a pair of positioning members mounted on opposite sides of the housing. The housing defines a pair of recesses in respective opposite sides of a bottom portion thereof, and a pair of symmetric grooves in opposite sides of a rear surface thereof respectively. Each groove has an L-shaped profile, and defines a slot in an adjacent sidewall of the housing. Each positioning member comprises an engaging portion having an L-shaped profile engaging in the corresponding groove of the housing, a medial portion extending from the engaging portion alongside the corresponding sidewall of the housing, and a solder portion extending perpendicularly from the medial portion into the corresponding recess of the housing. The solder portion is adapted for mounting on a corresponding surface of a PCB by welding.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
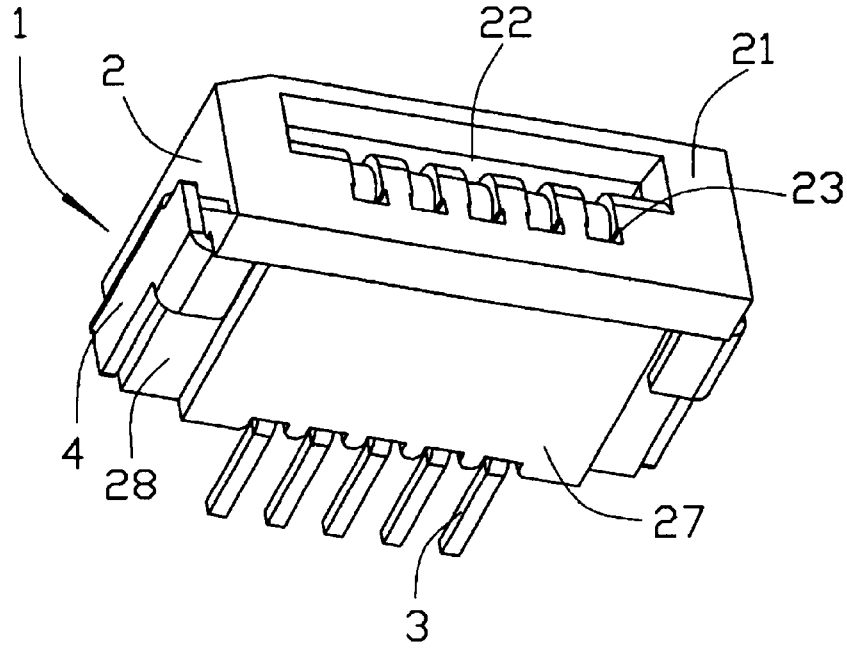
FIG. 1 is an isometric view of an electrical connector in accordance with the preferred embodiment of the present invention.
Figure 3:
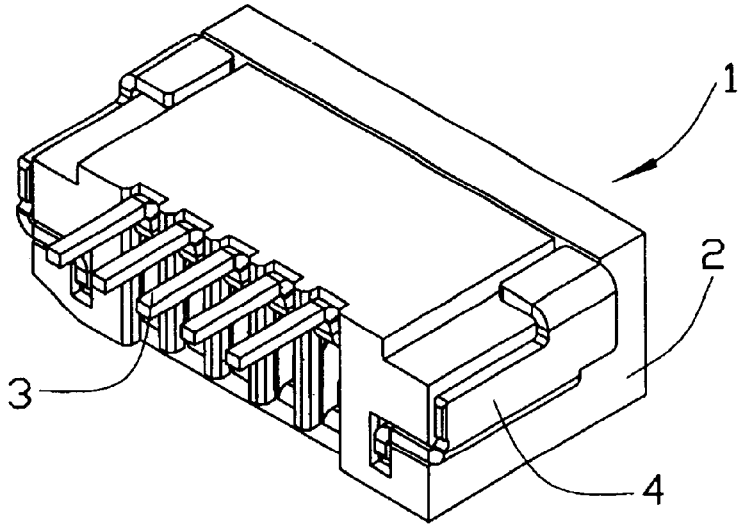
FIG. 3 is an assembled view of FIG. 2.
Figure 2:
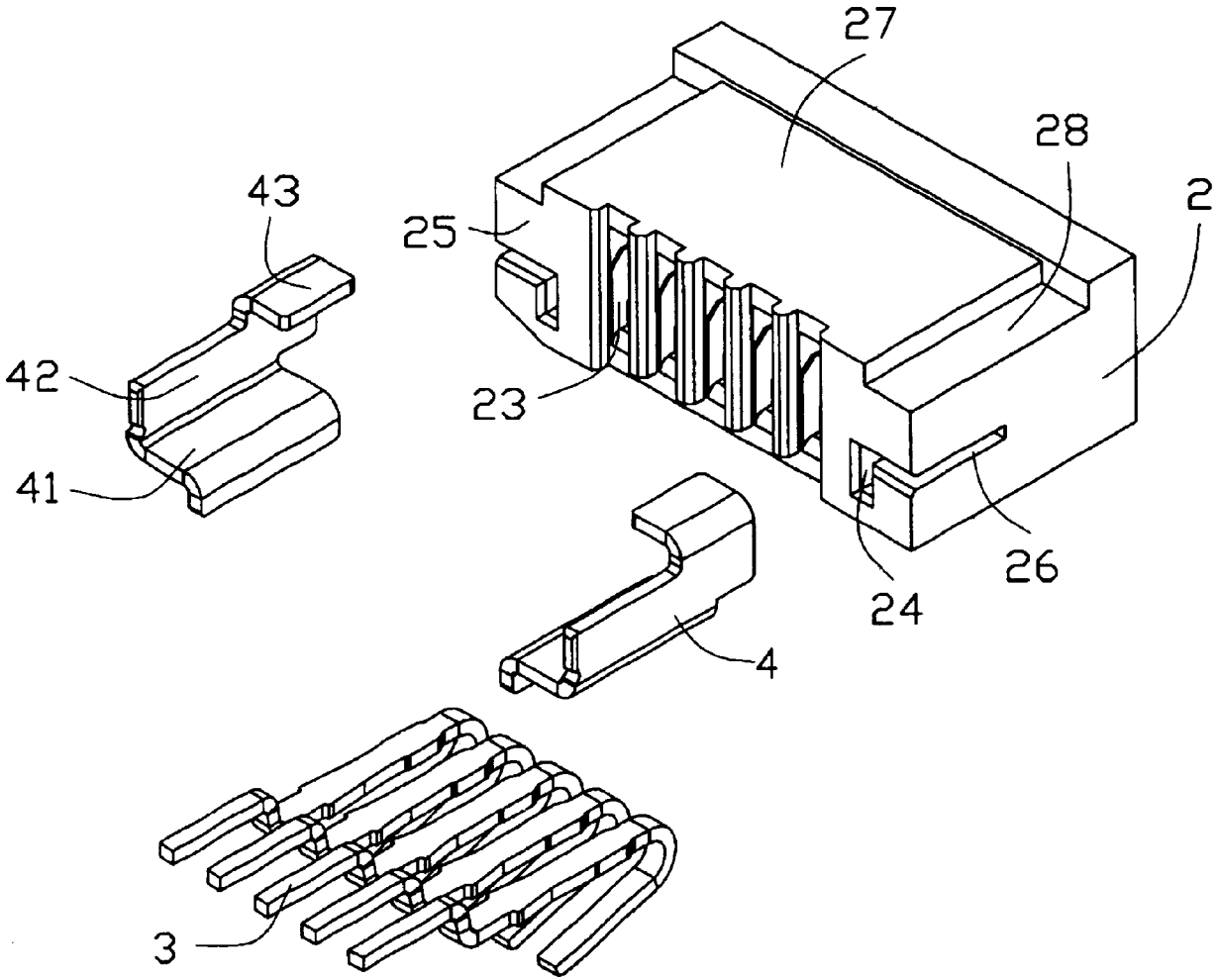
FIG. 2 is an exploded view of FIG. 1, but showing the electrical connector inverted.

Referring to FIGS. 1, 2 and 3, an electrical connector 1 is for mounting on a circuit substrate such as a printed circuit board (PCB)(not shown). The connector 1 comprises an insulative housing 2, a multiplicity of contacts 3 received in the housing 2, and a pair of positioning members 4 mounted on opposite sides of the housing 2.

The housing 2 comprises a front surface 21 for mating with a component such as another electrical connector (not shown), an opposite rear surface 25, a pair of sidewalls interconnecting the front surface 21 with the rear surface 25, and a bottom 27 adapted for being mounting on the PCB. The housing 2 defines a generally rectangular opening 22 in a middle portion of the front surface 21 thereof. A plurality of parallel elongate passageways 23 is defined in the housing 2, in communication with the opening 22. A pair of symmetric grooves 24 is defined in opposite sides of the rear surface 25 respectively. Each groove has an L-shaped profile, and defines a slot 26 in an adjacent sidewall. A pair of recesses 28 is defined in respective opposite side portions of the bottom 27 of the housing 2.

The contacts 3 are respectively received in the passageways 23. Solder ends of the contacts 3 extending outwardly from the passageways 23, and protrude coplanarly with each other from the rear surface 25 of the housing 2. A plane defined by the solder ends of the contacts 3 is parallel to the bottom 27 of the housing 2.

The positioning members 4 are each stamped and formed from a sheet of metallic material. Each positioning member 4 comprises an engaging portion 41 having an L-shaped profile, a medial portion 42 extending perpendicular from the engaging portion 41, and a solder portion 43 extending perpendicularly from the medial portion 42. The engaging portion 41 is adapted to slide into a corresponding groove 24, thereby mounting the positioning member 4 to the housing 2. The medial portion 42 abuts a corresponding sidewall of the housing 2. The solder portion 43 is received in a corresponding recess 28 of the housing 2, and is substantially flush with the bottom 27 of the housing 2.

The solder ends of the contacts 3 can electrically connect with corresponding solder pads of the PCB by welding. The solder portions 43 of the positioning members 4 are mounted on a corresponding surface of the PCB by welding, which facilitates firm mounting of the connector 1 on the PCB. As can be seen from FIGS. 1 and 2, the solder portions 43 are received entirely within the recesses 28 of the housing 2. Thus, welding of the solder portions 43 to the PCB is achieved without having to take up extra space on the PCB adjacent the bottom 27 of the housing 2. Accordingly, valuable space on the PCB is available for accommodating other electronic equipment and/or circuit lines. In addition, the configuration of each positioning member 4 and the corresponding configuration of the housing 2 are simple, thereby facilitating easy and inexpensive manufacturing.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector comprising:

a housing defining a pair of grooves each having an L-shaped profile on opposite sides of a rear surface thereof, and a pair of recesses defined in respective opposite side portions of a bottom thereof;

a plurality of contacts received in the housing, each of the contacts comprising a solder end extending outwardly from the housing; and a pair of positioning members respectively mounted on opposite sides of the housing, each of the positioning members comprising an engaging portion having an L-shaped profile received in a corresponding groove of the housing, a medial portion abutting a corresponding sidewall of the housing, and a solder portion received in a corresponding recess of the housing.

2. An electrical connector comprising:

an insulative housing defining a pair of L-shaped slots at two opposite end portions, respectively;

a pair of recesses formed in a bottom face of the housing under the corresponding L-shaped slots, respectively;

a plurality of contacts disposed in a middle portion of the housing; and a pair of metallic positioning members located around the end portions, respectively, each of said positioning members including a generally Z-shaped main body with a medial portion abutting against a corresponding end face of the housing and with a remainder portion received in the corresponding L-shaped slot;

wherein each of said positioning members further includes a solder portion extending from the medial portion and received in the corresponding recess.

3. A positioning device adapted for assisting in mounting an electrical connector on a printed circuit board (PCB), the electrical connector defining a pair of grooves each having an L-shaped profile in opposite sides of a rear surface thereof, and a pair of recesses in respective opposite side portions of a bottom thereof, the positioning device comprising a pair of positioning members, each of the positioning members comprising:

an engaging portion having an L-shaped profile adapted for being received in a corresponding groove of the electrical connector;

a medial portion extending perpendicularly from the engaging portion; and a solder portion extending perpendicularly from the medial portion adapted for being mounted on the PCB, the solder portion being adapted for being received within a corresponding recess of the electrical connector.

4. The positioning device as claimed in claim 3, wherein the positioning members are adapted for being mounted on opposite sides of a housing of the electrical connector.

* * * * *